United States Patent [19]

Klein et al.

[11] Patent Number: 4,524,867

[45] Date of Patent: Jun. 25, 1985

[54] CASE FOR ACCOMMODATING WRITTEN MATERIAL FOR PRESENTATION PURPOSES

[75] Inventors: Hans-Jörg Klein, Möhrendorf; Herbert Böhmer, Buckenhof, both of Fed. Rep. of Germany

[73] Assignee: Kraftwerk Union Aktiengesellschaft, Mülheim, Fed. Rep. of Germany

[21] Appl. No.: 565,517

[22] Filed: Dec. 27, 1983

Related U.S. Application Data

[63] Continuation of Ser. No. 280,091, Jul. 2, 1981, abandoned.

[51] Int. Cl.[3] ..... B65D 25/14; B65D 57/00

[52] U.S. Cl. ..... 206/232; 40/10 D; 190/16; 190/110; 190/124; 206/45.34; 206/459

[58] Field of Search ..... 40/10 D, 10 R, 124.4; 190/16, 100, 124, 125, 109, 110; 206/0.83, 44 R, 44 B, 45.31, 45.32, 45.33, 45.34, 216, 232, 309, 312, 313, 424, 425, 449, 450, 457, 459, 462, 472, 473, 579; 220/339

[56] References Cited

U.S. PATENT DOCUMENTS

| | | | |
|---|---|---|---|
| 1,453,658 | 5/1923 | Clough | 40/10 R |
| 2,319,127 | 5/1943 | Guenther et al. | 190/55 R |
| 2,428,498 | 10/1947 | McWilliams | 206/0.83 |
| 2,985,284 | 5/1961 | Levy | 206/0.83 |
| 2,998,126 | 8/1961 | Jenkins | 206/0.83 |
| 3,111,220 | 11/1963 | Bostrom | 206/462 |
| 3,370,697 | 2/1968 | Levey et al. | 206/45.34 |
| 3,586,349 | 6/1971 | Green et al. | 206/232 |

FOREIGN PATENT DOCUMENTS

| | | | |
|---|---|---|---|
| 973806 | 9/1950 | France | 206/216 |
| 2423411 | 12/1979 | France | 220/339 |
| 17820 | of 1910 | United Kingdom | 40/1 |

*Primary Examiner*—George F. Lowrance
*Assistant Examiner*—Jimmy G. Foster
*Attorney, Agent, or Firm*—Herbert L. Lerner; Laurence A. Greenberg

[57] ABSTRACT

Case for accommodating written material for presentation includes a clear box formed of transparent plastic having walls and an interior, and receptacles for written material being disposed in the interior of the box allowing the written material to be read through the walls of the box, the receptacles being adapted to the format of the written material for preventing sliding of the written material.

4 Claims, 3 Drawing Figures

CASE FOR ACCOMMODATING WRITTEN MATERIAL FOR PRESENTATION PURPOSES this application is a continuation of application Ser. No. 280,091, filed July 2, 1981 now abandoned.

The invention relates to a case for accommodating written material for presentation purposes, such as promotion literature and display labels. At conventions, trade fairs and public meetings, there is a need to handle, transport, and display promotion material. It may be advertising literature, leaflets or stick-on labels, requiring a display in such a manner that it catches the eye and wherein by carrying the case itself, an advertising effect is already achieved.

It is accordingly an object of the invention to provide a case for accommodating written material for presentation purposes, which overcomes the disadvantages of the heretofore-known devices of this general type, and which fills this need, and furthermore can be easily and economically manufactured, so that the whole case including its content can be given to the visitors of conventions and trade fairs as a promotional gift.

With the foregoing and other objects in view, there is provided, in accordance with the invention, a case for accommodating written material for presentation purposes, such as promotion literature and display labels, comprising a clear box formed of transparent glass-like plastic having walls and an interior and receptacles for written material being disposed in the interior of the box allowing the written material to be read through the walls of the box, the receptacles being adapted to the format of the written material for preventing sliding of the written material.

In accordance with another feature of the invention, the box is in the form of an attache case.

In accordance with a further feature of the invention, the box includes two molded similar case halves formed of thin clear-as-glass plastic material, and a folding hinge connecting the case halves to each other for folding the halves open and closed.

In accordance with an added feature of the invention, each of the case halves have recessed grips formed therein which are aligned or coincide in a closed position of the case, and reinforcement ribs connecting the grips to the remainder of the box.

In accordance with an additional feature of the invention, the reinforcement ribs are substantially triangular corner-filling lamina.

In accordance with yet another feature of the invention, the walls are removable and reusable inserted transparent (clear as glass) plastic walls, and the receptacles are molded in the inserted walls for round and/or oval stick-on labels, and including opaque plastic positioning walls having molded shapes formed therein which are receivable in the molded receptacles of the inserted walls.

In accordance with yet a further feature of the invention, the positioning walls are formed of a material from the group consisting of colored and black plastic.

In accordance with yet an added feature of the invention, the box includes two molded similar case halves formed of thin clear plastic material, each having an inserted wall, a positioning wall and secured written material received therein.

In accordance with yet an additional feature of the invention, the receptacles have a greater depth than the holding shapes formed in the positioning walls, for accommodating a plurality of sheets of written material in the receptacles.

In accordance with again another feature of the invention, the case halves have hollow spaces formed therein, and the inserted walls are surrounded by a rim having a depth substantially corresponding to the depth of the receptacles forming guiding and spacing means for fitting the inserted walls into the hollow spaces.

In accordance with a concomitant feature of the invention, the receptacles of one case half is a compartment for holding parts of a puzzle and the receptacles of the other case half is a compartment for holding a sample design for the puzzle which is visible from outside the box. The puzzle-part compartment is preferably DIN A 4 or DIN A 5 size and the sample design compartment is preferably DIN A 3 size, such as for folding a poster, perhaps of a power plant. The advantage obtained by use of the subject matter of the invention is especially the fact that a tool has been created by which the promotion for a firm or for a program can be forcefully presented. A particularly advantageous possible application is, for example, the promotion of a sensible energy policy. However, it is also feasible for political parties to use the subject of the invention in an election battle.

Other features which are considered as characteristic for the invention are set forth in the appended claims.

Although the invention is illustrated and described herein as embodied in case for accommodating written material for presentation purposes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
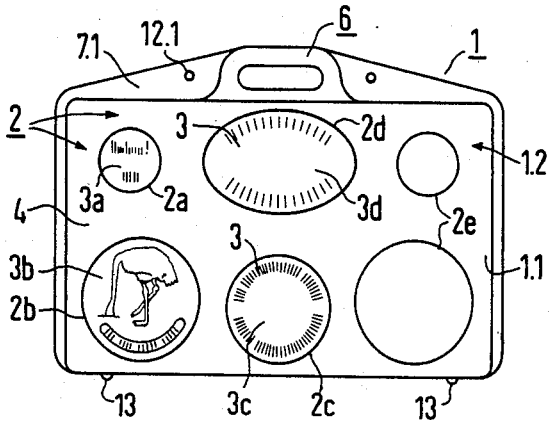
FIG. 1 is a diagrammatic top plan view, looking down on an embodiment of the case of the invention.

Referring now to the drawing and first, particularly, to FIG. 1 thereof, it is seen that the case is constructed as a transparent clear-as-glass box 1. The box is formed of a transparent plastic, with a wall thickness of about 0.3 to 0.5 mm. In the interior of the transparent box 1, which is hereinbelow called "case" for short, there are receptacles 2 for the written material 3, which are adapted to the format of the written material in such a way that the material cannot slide around when the case is transported, and it can furthermore be read through the walls 4 of the case. The individual receptacles 2*a*, 2*b*, 2*c* and 2*e* have circular shapes of different size, while the receptacle 2*d* has an elliptical shaped plan view. Correspondingly shaped stick-on labels individually designated as 3*a* to 3*d* are kept in the receptacles 2*a* to 2*d* in stacks or decks. The receptacles 2*e* are shown empty in FIG. 1, but obviously can also be used.

Figure 2:
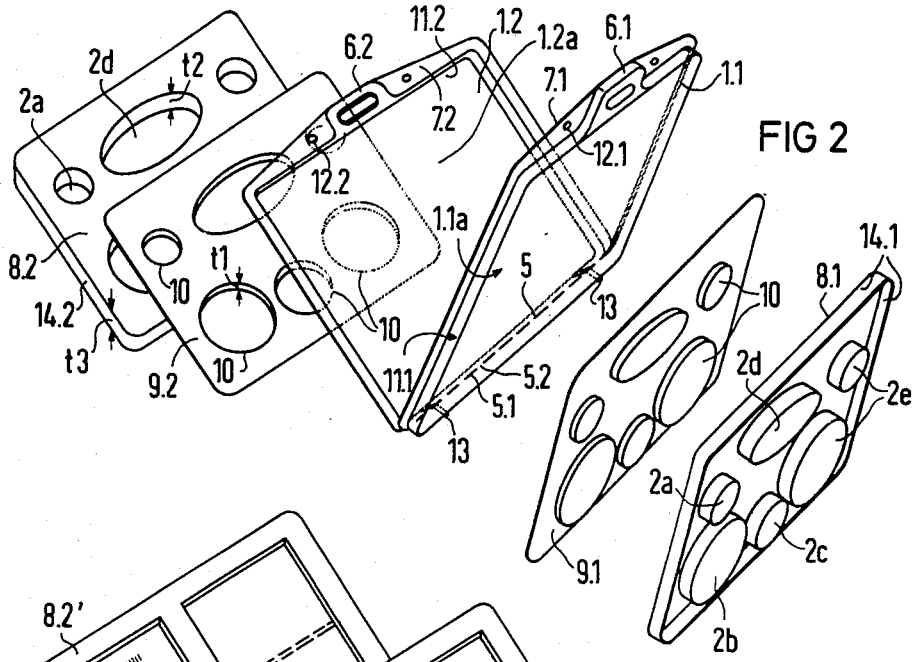
FIG. 2 is an exploded perspective view of the case according to FIG. 1 in which the insert and positioning walls are taken out.
Figure 3:
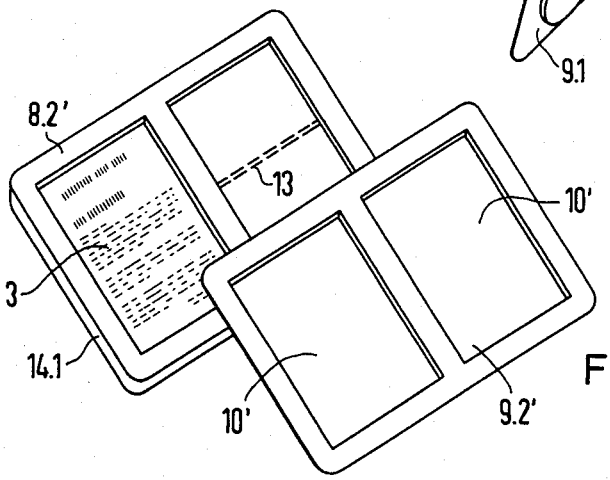
FIG. 3 is a diagrammatic perspective view of a second embodiment for insert and positioning walls for accommodating DIN A 4 format written material.

It can be seen from FIGS. 1 and 2 that the case 1 has the form of an attache case. This form is especially advantageous if it is the intention to also transport literature in the DIN A 4 or DIN A 5 formate with the case, as shown in FIG. 3. The shape of the case is essentially rectangular with rounded corners, and has a size which is selected such that two DIN A 4 formates can be contained in each half of the case.

For this reason, the case preferably includes two similar case parts 1.1 and 1.2, made of thin molded or formed transparent material which are connected to each other by a folding hinge 5 (as seen in FIG. 2). This folding hinge 5 can be somewhat thinner than the other wall thickness of the case, or it can be formed by slots 5.1 and bars 5.2 which alternate with each other. Each half of the case is provided with recessed formed grips 6.1, 6.2 which are aligned in the closed position of the case. These grips are connected with the remainder of the case by reinforcement ribs 7.1, 7.2. These reinforcement ribs are constructed as approximately triangular-shaped, corner-filling lamina, as shown in FIG. 2. At the bottom of the case, side ribs or bars for standing the case up are designated with reference numeral 13 (as seen in FIGS. 1, 2).

Furthermore, FIG. 2 shows that inserted walls are fitted into the case-halves 1.1, 1.2; insert wall 8.1 for case-half 1.1 and insert wall 8.2 for case-half 1.2. The walls include molded-in receptacles *2a* to *2e*, as explained in FIG. 1. These inserted walls 8.1, 8.2 are also formed of transparent plastic (clear-as-glass), exactly as the case 1 itself.

However, the inserted wall 8.2 does not have to contain exactly the same receptacles 2 as the inserted wall 8.1; it can, for example, be as shown in FIG. 3, (using inserted wall 8.2'). In the embodiment according to FIGS. 1 and 2, the receptacles 2 of both inserted walls 8.1, 8.2 have either a round or an oval shape, for storing correspondingly shaped stick-on labels. The stick-on labels, which are to be placed in the receptacles with their letter and picture side facing outward, are held in position by positioning or fixing walls 9.1 and 9.2 which are made of colored or black plastic. For this purpose, the positioning walls 9.1, 9.2 are provided with molded shapes 10, which are formed from the inside toward the outside, similar to the receptacles, and have dimensions which correspond to the inner dimensions of the receptacles 2. However, the depth t1 of the shapes 10 is less than the depth t2 of the receptacles of the inserted walls 8.1, 8.2 so that the printed material fits into the hollow spaces formed thereby and the positioning walls 9.1, 9.2 can be form-fittingly fitted together with the respective insertion walls 8.1, 8.2. In other words, the shape of the parts assures that they will fit together. These combined units can then be placed into the case 1, i.e. into the recesses 11.1, 11.2 of the two case-halves 1.1, 1.2. Therefore, the rim 14.1, 14.2 which extends all around the inserted walls 8.1, 8.2, forms a guide and spacing means. In this way, the rim fits exactly into the inner spaces 1.2*a*, 1.1*a* of the case-halves 1.1, 1.2.

The depth t3 of the rim corresponds approximately to the depth t2 of the receptacles. The two case-halves can then be folded together, i.e. the case can be closed, and for this purpose, button-like protrusions 12.1 and associated recesses 12.2 are formed into the region of the reinforcement bars 7.1, 7.2. The protrusions and recesses engage each other by elastic deformation in the closed position.

As already mentioned, instead of one or both inserted walls 8.1, 8.2, inserted walls 8.2' according to FIG. 3 and associated positioning walls 9.2 can be used. In this case, the receptacles are formed for receiving of printed matter 3' in the DIN A 4 format. It would be also possible to store and securely position printed material in the DIN A 5 format if, as indicated in FIG. 3, the DIN A 4 receptacles 3' are again subdivided in two receptacle-halves by an intermediate rib 13. The holding portions of the positioning wall 9.2' are designated with reference numeral 10' in FIG. 3.

The outer part of the case, and the two case-halves 1.1, 1.2, are formed of glass-clear PVC of 0.5 mm and 500μ thickness, respectively. The inserted walls 8.1, 8.2 are formed of the same material with a thickness of 300μ. The positioning walls 9.1, 9.2 are made of black, impact resistant polystyrol having a thickness of 500μ.

The case can also be advantageously used to package a toy-puzzle, especially an energy puzzle wherein, for example, on DIN A 4 or DIN A 5 compartment contains a plastic bag with parts of the puzzle in the form of tiles or stamped parts, and one case cover or case-half contains a DIN A 3 sample design, preferably arranged in such a manner that the sample design, such as a nuclear power plant pictured in color, can be seen from the outside. After taking out the plastic bag with the puzzle parts, one can start with the puzzle, and the case with the puzzle picture design will serve as the sample design.

There is claimed:

1. Case for accommodating written material for presentation, comprising two molded similar case halves formed of thin clear plastic material, said case halves each having a case wall with an inner space formed therein, a folding hinge connecting said case halves to each other for folding said halves open and closed, at least one removable and reusable transparent plastic wall inserted in each respective case half, said inserted walls each having receptacles with substantially planar surfaces molded therein for the written material, at least one opaque plastic wall fixed in place in each respective case half, said fixed walls having shapes with substantially planar surfaces molded therein each being receivable in a respective one of said molded receptacles in assembled condition of the case, the shapes and said molded receptacles having predetermined depths and other dimensions, the shapes having less depth than said molded receptacles defining a space between said surfaces for receiving the written material, and said other dimensions of the shapes and said other dimensions of said molded receptacles being substantially equal, a recessed grip formed in each respective case half, said grips being mutually aligned in closed condition of the case, and reinforcement ribs connected to said grips, said inserted walls being surrounded by a rim having a depth substantially corresponding to the depth of said receptacles forming guiding and spacing means for fitting said inserted walls into said inner spaces.

2. Case according to claim 1, wherein said reinforcement ribs are substantially triangular corner-filling lamina.

3. Case according to claim 1, wherein said fixed walls are formed of colored plastic.

4. Case according to claim 1, wherein said fixed walls are formed of black plastic.

* * * * *